US007416620B2

(12) United States Patent
Sundberg et al.

(10) Patent No.: US 7,416,620 B2
(45) Date of Patent: Aug. 26, 2008

(54) COPPER ALLOY AND METHOD FOR ITS MANUFACTURE

(75) Inventors: Mariann Sundberg, Västerås (SE); Rolf Sundberg, Västerås (SE); Sture Östlund, Västerås (SE)

(73) Assignee: Luvata Oy, Espoo (FI)

( * ) Notice: Subject to any disclaimer, the term of this patent is extended or adjusted under 35 U.S.C. 154(b) by 481 days.

(21) Appl. No.: 10/821,293

(22) Filed: Apr. 9, 2004

(65) Prior Publication Data

US 2004/0187978 A1 Sep. 30, 2004

Related U.S. Application Data

(62) Division of application No. 09/562,781, filed on May 2, 2000, now abandoned, which is a division of application No. 08/919,499, filed on Aug. 28, 1997, now abandoned.

(30) Foreign Application Priority Data

Aug. 29, 1996 (GB) ..... 9618033.6

(51) Int. Cl.
*C22F 1/08* (2006.01)

(52) U.S. Cl. ..... 148/554; 148/684; 148/685

(58) Field of Classification Search ..... 148/554, 148/684, 685
See application file for complete search history.

(56) References Cited

U.S. PATENT DOCUMENTS 4,710,349 A 12/1987 Yamazaki et al.
4,810,468 A 3/1989 Duerrschnabel et al.
4,851,191 A 7/1989 Lee et al.

FOREIGN PATENT DOCUMENTS

| | | |
|---|---|---|
| DE | 2538056 | 3/1977 |
| DE | 36 34 495 | 4/1987 |
| GB | 2 178 448 | 2/1987 |
| GB | 2 182 054 | 5/1987 |
| GB | 2 219 473 | 12/1989 |
| GB | 2 287 716 | 9/1995 |
| JP | 55011145 | 1/1980 |
| JP | 55047337 | 4/1980 |
| JP | 56102537 | 8/1981 |
| JP | 60050161 | 3/1985 |
| JP | 61127837 | 6/1986 |
| JP | 62086151 | 4/1987 |
| JP | 63038543 | 2/1988 |
| JP | 1068436 | 3/1989 |
| JP | 3068730 | 3/1991 |
| JP | 3072040 | 3/1991 |
| JP | 5117789 | 5/1993 |
| JP | 5214489 | 8/1993 |
| JP | 5302155 | 11/1993 |
| JP | 6058688 | 3/1994 |

*Primary Examiner*—Sikyin Ip
(74) *Attorney, Agent, or Firm*—Smith-Hill and Bedell

(57) ABSTRACT

The invention relates to a copper alloy having high recrystallization temperature and good conductivity used in brazed heat exchangers which alloy consists of 0.1 to 0.3% in weight chromium. The invention also relates to a method for the manufacturing of the alloy which method consists of the following steps: casting, cold working, annealing and another cold working before brazing.

3 Claims, 1 Drawing Sheet

COPPER ALLOY AND METHOD FOR ITS MANUFACTURE

CROSS REFERENCE TO RELATED APPLICATIONS

Figure 1:
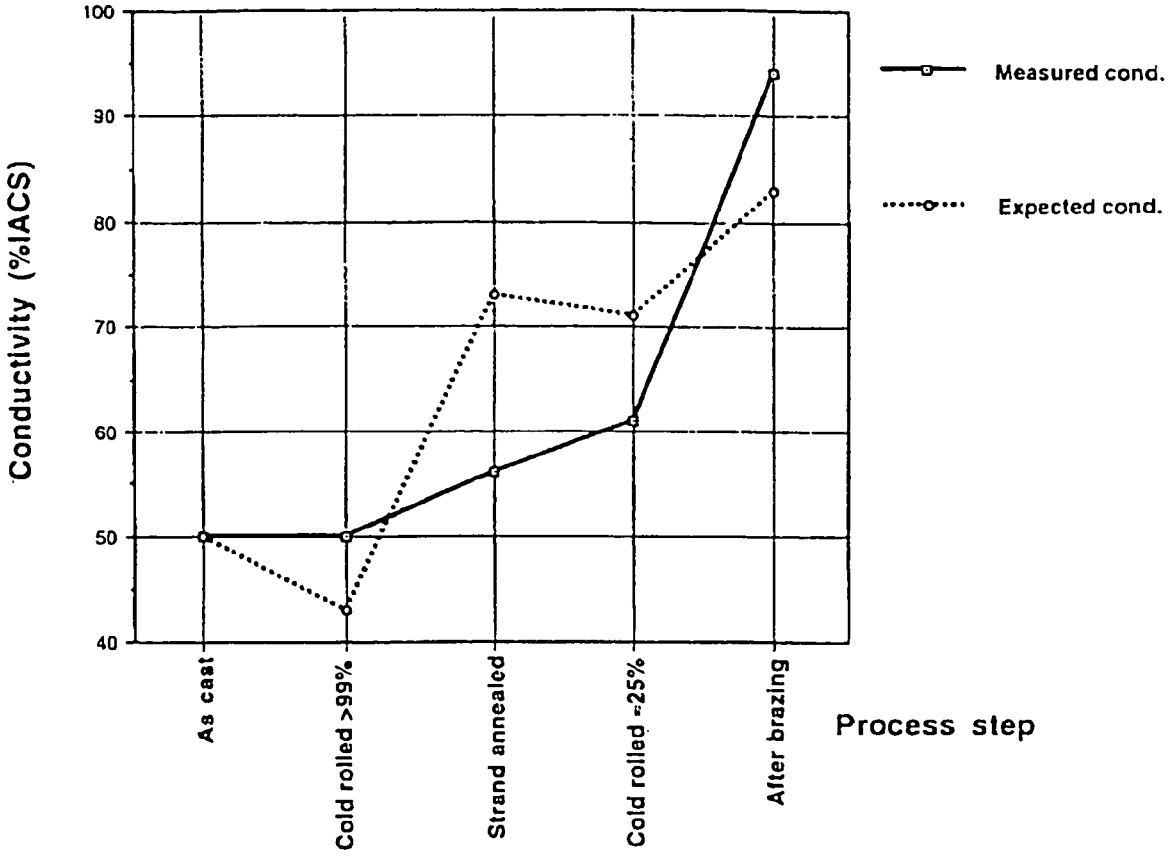

This is a divisional of U.S. patent application Ser. No. 09/562,781 filed May 2, 2000 (now abandoned), which was filed as a divisional of U.S. patent application Ser. No. 08/919,499 filed Aug. 28, 1997 (now abandoned), and claims priority under 35 USC 119 of United Kingdom Patent Application No. 9618033.6 filed Aug. 29, 1996.

The invention relates to a copper alloy and a method for its manufacture which alloy has a high recrystallization temperature as well as good electrical and thermal conductivity. The copper alloy of the invention is advantageously used as cooling fins in brazed heat exchangers for instance in automobiles.

A new joining technology for brazing using copper and brass for automotive heat exchangers has been developed in recent years. In brazing, the metallic parts of a heat exchanger are joined by a molten metal, i.e. a filler metal, the melting temperature whereof is lower than that of the parts to be joined. The brazing is similar to the soldering. However, in brazing the working temperature is more than 450° C. The working temperature of the brazing filler metal depends on the chemical composition of the filler material. In the U.S. Pat. No. 5,378,294 there is described a brazing filler alloy which is based on low-nickel copper alloys having a low melting temperature and being self-fluxing. The working temperature for these alloys is between 600 and 700° C.

The mechanical properties of the metal used in a heat exchanger are reached through alloy additions and cold working. In the heat exchangers there are usually fins and tubes which are soldered or brazed together. A cold worked metal will start to soften, i.e. recrystallize when heated. Therefore, alloy additions are made to the fin material to increase the softening temperature. It is necessary that the fins of the heat exchangers retain as much as possible of their original hardness after joining. In the U.S. Pat. No. 5,429,794 there are described copper-zinc alloys suitable for heat exchangers, particularly for radiators, because they can be brazed without losing too much strength.

When thinking of the conductivity of a heat exchanger material, the alloying of copper will decrease the electrical conductivity, as in the alloys of the U.S. Pat. No. 5,429,794. Now it is surprisingly noticed that there is a copper alloy for heat exchangers which alloy has good electrical conductivity. Therefore, the object of the present invention is to eliminate some of the drawbacks of the prior art and to achieve a better alloy and a method for manufacturing that alloy used in heat exchangers which alloy is low-alloyed copper and is easy to braze, so that the alloy has high recrystallization temperature as well as has good electrical conductivity. The essential novel features of the invention are apparent from the appended claims.

According to the invention phosphorus deoxidized copper is alloyed by chromium in which alloy the chromium content is between 0.1 and 0.3% by weight advantageously between 0.15 and 0.25% by weight. Preferably the alloy consists essentially of copper and chromium, any other materials present being incidental constituents and impurities.

The alloy of the invention has a high recrystallization temperature, eg. at least 625 ° C. which is convenient for brazing in order to prevent the softening. This is because brazing is normally done at the temperature of more than 600° C. The alloy is advantageously manufactured through continuous casting and cold working so that the electrical conductivity after brazing is at least 90% IACS (International Annealed Copper Standard).

The alloy of the invention is manufactured by a method which advantageously includes the following steps: casting, cold working, annealing and another cold working before brazing. The casting step can advantageously be carried out as a continuous strip casting. At least one of the cold working steps is preferably carried out by rolling. When carrying out the annealing step it is advantageously with a strand annealing, i.e. a rapid annealing in which the annealing time is between 0 to 30 seconds eg. 0.01 to 30 seconds preferably 1 to 10 seconds and the annealing temperature is at the range between 700 and 900° C., preferably 700 to 800° C.

Using the manufacturing method of the invention, the electrical conductivity of the alloy increases during every step. This is believed to be because the precipitation of chromium takes place in all steps. The precipitates have a fine distribution and good stability. During the brazing step essentially all chromium of the alloy is precipitated and the alloy then has good electrical conductivity. Because the copper alloy of the invention has good electrical conductivity also, the thermal conductivity is good and the alloy is suitable for heat exchangers.

The invention is described in details in the following example with reference to the drawing, the single figure of which is a graph illustrating the effect of the process steps on the electrical conductivity of an alloy in accordance with the invention.

EXAMPLE

The alloy in accordance with the invention having 0.2% by weight chromium, rest copper, was first cast using a continuous strip cast. After casting the electrical conductivity was measured arid the value was 50% IACS. The strip cast alloy was then cold rolled to the thickness of less than 0.1 mm and the value for the electrical conductivity was 50% IACS. The rolled alloy was then annealed at the temperature of 750° C. for 5 seconds. After this annealing step the electrical conductivity had a value of 56% IACS. The alloy was again cold rolled to the final dimension of 0.05 mm and the value of the electrical conductivity was 61% IACS. The brazing was then done for the final product at the temperature of 6250° C. After brazing the value for the electrical conductivity was again measured and the value was 94% IACS.

The yield strength of the fins made of the copper alloy of the invention after brazing was 250 MPa and the fins were not recrystallized. The above described variation of the electrical conductivity is illustrated in the drawing. The drawing also illustrates as a comparison the theoretical conductivity. The theoretical values are calculated from the equilibrium diagram for the copper-chromium system. The curves show the influence of chromium in solid solution on electrical conductivity. The influence of cold deformation is taken from the relation between electrical conductivity for low-alloyed copper and reduction during cold deformation. The alloy manufactured by the method of the invention has 10% IACS better conductivity after brazing than the theoretical conductivity.

The invention claimed is:

1. A method of manufacturing an automotive heat exchanger, comprising:

forming fin material of a copper alloy consisting of copper, 0.1 to 0.3% by weight chromium and incidental impurities by casting, a first cold working, annealing and a second cold working, whereby the recrystallization temperature of the alloy is at least 625° C., and brazing the fin material to a heat exchanger tube, wherein the casting step is a continuous strip casting step, the first cold working step is a rolling step, the annealing step is a strand annealing step that is carried out for a time up to 30 seconds at a temperature in the range from 700 to 900° C., and the second cold working step is a rolling step.

2. A method according to claim 1, wherein the alloy contains 0.15 to 0.25% by weight chromium.

3. A method according to claim 1, wherein the strand annealing step is carried out for a time in the range from 1 to 10 seconds.

* * * * *